US009416684B2

(12) United States Patent
Deister et al.

(10) Patent No.: US 9,416,684 B2
(45) Date of Patent: Aug. 16, 2016

(54) METHOD FOR A TEMPERATURE COMPENSATION IN A STEAM TURBINE

(75) Inventors: Frank Deister, Willich (DE); Ingo Forster, Mulheim/Ruhr (DE); Daniel Gloss, Mulheim an der Ruhr (DE); Christian Musch, Essen (DE); Heinrich Stuer, Haltern (DE); Frank Truckenmuller, Bochum (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 197 days.

(21) Appl. No.: 14/241,273

(22) PCT Filed: Aug. 3, 2012

(86) PCT No.: PCT/EP2012/065215
§ 371 (c)(1),
(2), (4) Date: Feb. 26, 2014

(87) PCT Pub. No.: WO2013/034377
PCT Pub. Date: Mar. 14, 2013

(65) Prior Publication Data

US 2014/0366538 A1 Dec. 18, 2014

(30) Foreign Application Priority Data

Sep. 5, 2011 (EP) ..... 11180026

(51) Int. Cl.

| | |
|---|---|
| ***F01K 13/02*** | (2006.01) |
| ***F01D 25/26*** | (2006.01) |
| ***F01K 7/16*** | (2006.01) |
| ***F01D 11/04*** | (2006.01) |

(52) U.S. Cl.
CPC ..... *F01K 13/02* (2013.01); *F01D 11/04* (2013.01); *F01D 25/26* (2013.01); *F01K 7/165* (2013.01); *F01K 13/025* (2013.01); *F05D 2220/31* (2013.01)

(58) Field of Classification Search
CPC ..... F01K 13/02; F01K 13/025; F01K 7/165; F01D 11/04; F01D 25/26; F05D 2220/31
USPC ..... 60/646, 657, 658; 415/116, 175, 229
See application file for complete search history.

(56) References Cited

U.S. PATENT DOCUMENTS

| | | | |
|---|---|---|---|
| 2,815,645 | A | 12/1957 | Downs |
| 6,241,465 | B1 | 6/2001 | Kuhn |
| 6,478,534 | B2 | 11/2002 | Bangert |

(Continued)

FOREIGN PATENT DOCUMENTS

| | | | |
|---|---|---|---|
| CN | 1550644 | A | 12/2004 |
| CN | 101622424 | A | 1/2010 |

(Continued)

*Primary Examiner* — Hoang Nguyen
(74) *Attorney, Agent, or Firm* — Beusse Wolter Sanks & Maire

(57) ABSTRACT

A structure and method are provided for preventing or at least minimizing thermally-induced structural distortions, such as may occur when a steam turbine is cooling down. The steam turbine may include an inner housing and an outer housing. An intermediate space is formed between the inner housing and the outer housing, and sealing steam may be injected into the intermediate space to avoid the formation of temperature strata in the interspace and thus prevent the outer housing from bowing.

5 Claims, 1 Drawing Sheet

(56) References Cited

U.S. PATENT DOCUMENTS

| | | | | |
|---|---|---|---|---|
| 7,003,956 | B2 | 2/2006 | Yamashita et al. | |
| 8,713,941 | B2 | 5/2014 | Pfitzinger | |
| 2004/0175264 | A1* | 9/2004 | Diesler | F01D 3/04 415/116 |
| 2005/0022529 | A1 | 2/2005 | Fukuda | |
| 2006/0233634 | A1* | 10/2006 | Tisenchek | F01D 11/06 415/1 |
| 2010/0034641 | A1 | 2/2010 | Ikeda | |
| 2012/0027565 | A1* | 2/2012 | Maruthamuthu | F01D 11/04 415/1 |
| 2012/0082546 | A1* | 4/2012 | Grieshaber | F01D 11/04 415/230 |
| 2013/0170956 | A1* | 7/2013 | Almstedt | F01D 3/04 415/116 |

FOREIGN PATENT DOCUMENTS

| | | | |
|---|---|---|---|
| EP | 1630360 | | 3/2006 |
| EP | 1630360 | A1 | 3/2006 |
| EP | 2067933 | | 6/2009 |
| JP | H05288007 | A | 11/1993 |
| JP | 2001518588 | A | 10/2001 |
| JP | 2002523661 | A | 7/2002 |
| JP | 2003148109 | A | 5/2003 |
| JP | 2003254010 | A | 9/2003 |
| JP | 2003328702 | A | 11/2003 |
| JP | 2004346932 | | 12/2004 |
| JP | 200560826 | A | 3/2005 |
| JP | 2005060826 | A | 3/2005 |
| JP | 2010038101 | A | 2/2010 |
| WO | 2008104465 | | 9/2008 |
| WO | WO2008104465 | | 9/2008 |

* cited by examiner

METHOD FOR A TEMPERATURE COMPENSATION IN A STEAM TURBINE

CROSS REFERENCE TO RELATED APPLICATIONS

This application is the U.S. National Stage of International Application No. PCT/EP2012/065215 filed Aug. 3, 2012, and claims the benefit thereof. The International Application claims the benefit of European Application No. 11180026 filed Sep. 5, 2011. All of the applications are incorporated by reference herein in their entirety.

FIELD OF INVENTION

The invention relates to a steam turbine comprising an outer housing, an inner housing arranged inside the outer housing and a rotor rotatably mounted inside the inner housing, wherein an interspace is formed between the inner housing and the outer housing, wherein a sealing steam seal is formed between the outer housing and the rotor.

The invention further relates to a method for avoiding distortion of the housing of a steam turbine.

BACKGROUND OF INVENTION

The turbine housing of a steam turbine generally comprises an inner housing and an outer housing, an interspace being formed between the inner housing and the outer housing. These two housing parts in turn have an upper half and a lower half; in the case of high-pressure turbines the outer housing is also embodied as a barrel-type design. In particular after shutdown of the steam turbine there appear, at and between the housings, temperature differences between the lower half and the comparatively hot upper half which can be several degrees Kelvin.

If the steam turbine is shut down, the outer housing cools faster than the inner housing. As a consequence of free or natural convection, this induces an upward flow in the interspace between the inner housing and the outer housing which causes heat to be introduced into the upper half of the outer housing. This, in turn, may lead to distortion of the housing, particularly in the upper half of the outer housing, with the result that, there, undesirable stresses arise in the housing material and clearances are closed. Distortion of the inner housing can lead to undesirable rubbing-induced damage if, in adverse situations, turbine blades rub against the housing.

Steam turbines generally have an inner housing and an outer housing which surrounds the inner housing, with this double casing housing construction forming an interspace. The inner housing is at least partly encased, in its axial extent, by a cladding arranged in the interspace.

After a steam turbine is shut down or has shed load, there is a certain quantity of steam in the space between the inner and outer housing, depending on the prevailing pressure. Natural convection gives rise to temperature stratification between the upper and lower regions in the housing or, as the case may be, in the interspace. These different temperatures lead to distortion of the outer housing, which is also termed bowing. This "bowing" is to be avoided as the inner housing rests on the outer housing, inside the latter, and the distortion can cause the inner housing to be misaligned with respect to the rotor, which, at worst, results in closure of the radial clearances and possibly in rubbing.

Until now, this problem has been solved by providing a sufficiently large radial clearance. However, this causes a deterioration in efficiency.

SUMMARY OF INVENTION

Aspects of the invention are directed to structures for preventing or at least minimizing distortion of the outer housing of a turbine engine, such as when the turbine is cooling down. Moreover, a method for avoiding distortion of the housing when the turbine is shut down should be indicated.

In one non-limiting embodiment, a steam turbine comprising an outer housing, an inner housing arranged inside the outer housing and a rotor rotatably mounted inside the inner housing, wherein an interspace is formed between the inner housing and the outer housing, wherein a sealing steam seal is formed between the outer housing and the rotor, wherein the outer housing has an inflow opening for introducing the sealing steam into the interspace.

In another non-limiting embodiment, a method for avoiding distortion of the housing of a steam turbine when the steam turbine is shut down, in which, in an interspace formed between an inner housing and an outer housing surrounding the inner housing, the introduction of sealing steam into the interspace, via an opening in the outer housing, induces turbulence in the medium in the interspace.

The invention is based on the knowledge that the formation of temperature strata in the interspace is avoided by injecting sealing steam. This causes turbulence in the strata and thus a reduction in the thermal stresses, which in turn reduces the distortion of the outer housing.

The inflow opening is fluidically connected to the sealing steam seal, which is a comparatively cost-effective solution.

Advantageously, a sealing steam line is formed which, on one hand, allows sealing steam to be introduced into the sealing steam seal and, on the other hand, has a branch line which is fluidically connected to the inflow opening.

BRIEF DESCRIPTION OF THE DRAWINGS

An exemplary embodiment of the invention will be explained in more detail below with reference to a schematic drawing, in which.

DETAILED DESCRIPTION OF INVENTION

Figure 1:
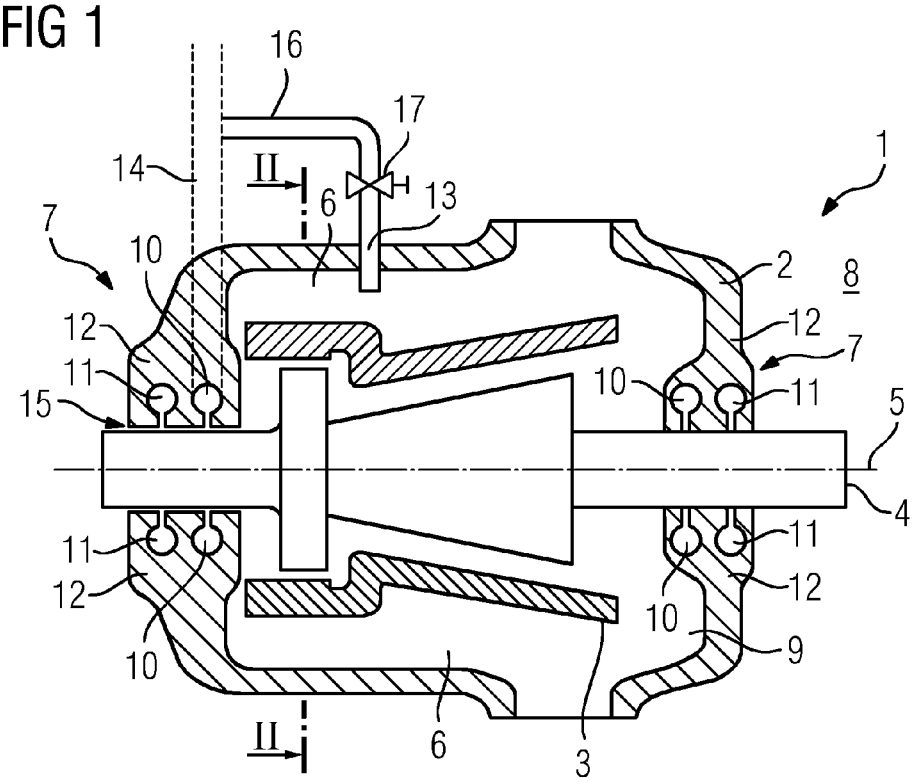
FIG. 1 shows a cross section view of a steam turbine.

FIG. 1 shows, represented in a cross section view, a steam turbine 1 comprising an outer housing 2 and an inner housing 3 arranged inside the outer housing 2. Inside the inner housing 3, a rotor 4 is mounted rotatably about an axis of rotation 5. An interspace 6 is formed between the inner housing 3 and the outer housing 2. The inner housing 3 and the outer housing 2 can both be split into a first, upper partial region, the upper half, and a second, lower partial region, the lower half.

The steam turbine 1 further has a seal region 7 which separates an outer space 8 from an inner space 9 of the steam turbine 1. No fluidic connection should be made in the seal region 7 between the rotor and the outer housing 2. To that end, the seal region 7 has a sealing steam opening 10 which is formed such that cold sealing steam, which can be introduced from outside, can flow into a gap between the outer housing 2 and the rotor 4. Mixed steam is extracted again with the aid of what are termed vapor steam extractors 11.

A sealing steam seal 12 is thus formed between the outer housing 2 and the rotor 4. The outer housing 2 has an inflow opening 13 for introducing sealing steam into the interspace 6. Turbulence is thus induced in the steam in the interspace 6 by the sealing steam flowing in via the inflow opening 13, which increases the natural convection in the interspace 6 and thus avoids bowing of the outer housing 2.

The inflow opening 13 is fluidically connected to the sealing steam opening 10.

Figure 2:
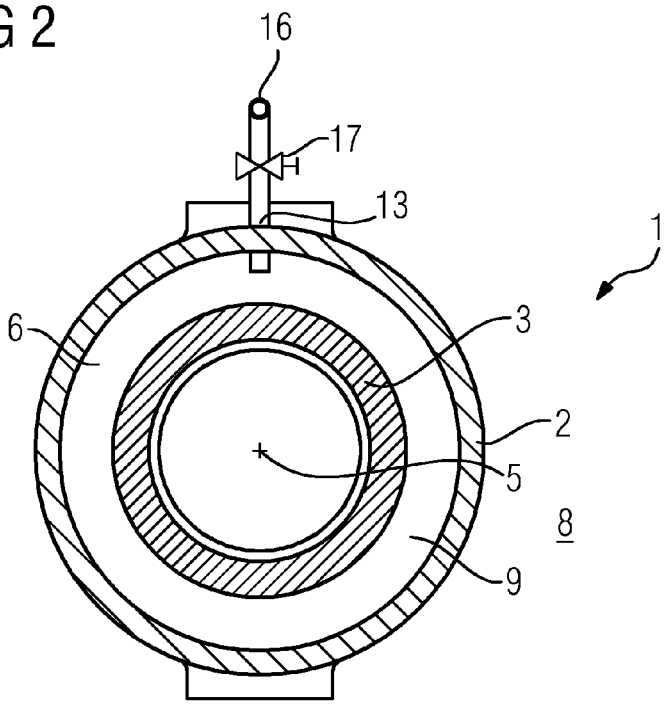
FIG. 2 shows a cross section view of a steam turbine, as seen in the flow direction.

FIG. 2 shows a cross section of the steam turbine 1 as seen in the direction of the axis of rotation 5. In the exemplary embodiment represented in FIG. 2, the inflow opening 13 is arranged in a 12 o'clock position in the outer housing 2.

FIG. 1 shows a sealing steam line 14 in which sealing steam is formed in a sealing space between the sealing steam seal 12 and the rotor 4.

The sealing steam line 14 is represented by dashed lines. A representation of the sealing steam line for the further sealing steam openings 10 shown in FIG. 1 has been omitted for reasons of clarity.

The sealing steam line 14 comprises a branch line 16 which is fluidically connected to the inflow opening 13. A valve 17 is arranged in the branch line 16 to regulate the flow of sealing steam.

By virtue of the equalization of the temperature distribution in the outer housing 2, brought about as a consequence of the turbulence induced in the steam in the interspace 6 via the inflow opening 13, the natural convection is counteracted such that housing distortions after shutdown and as the turbine cools are reliably prevented.

The invention claimed is:

1. A steam turbine comprising an outer housing, an inner housing arranged inside the outer housing and a rotor rotatably mounted inside the inner housing, wherein an interspace is formed between the inner housing and the outer housing and surrounds rotor blades disposed on the rotor, wherein a sealing steam seal is formed between the outer housing and the rotor, wherein the sealing steam seal has a sealing steam opening which is fluidically connected to a sealing steam line, wherein the sealing steam seal is supplied with sealing steam that is relatively cool compared to steam being sealed by the sealing steam seal;

wherein the outer housing has an inflow opening there through that opens directly into the interspace for introducing the sealing steam into the interspace, and wherein a sealing steam line that supplies the sealing steam to the inflow opening also supplies sealing steam to the sealing steam seal.

2. The steam turbine as claimed in claim 1, wherein the sealing steam line has a branch line which is fluidically connected to the inflow opening.

3. The steam turbine as claimed in claim 2, wherein the branch line comprises a valve.

4. A method for avoiding distortion of the housing of a steam turbine when the steam turbine is shut down, comprising introducing sealing steam into an interspace formed between an inner housing that surrounds a rotor and an outer housing surrounding the inner housing via an opening disposed through the outer housing and opening directly into the interspace, thereby inducing turbulence in the medium in the interspace, wherein the interspace surrounds rotor blades disposed on a rotor, and wherein the sealing steam is relatively cool compared to working steam inside the inner housing.

5. The method as claimed in claim 4, wherein the sealing steam is diverted from a sealing steam line which supplies sealing steam to the sealing steam seal.

* * * * *